US006568101B1

(12) United States Patent
Jansen et al.

(10) Patent No.: US 6,568,101 B1
(45) **Date of Patent: *May 27, 2003**

(54) SOFTSPIKE OVERSHOES

(76) Inventors: Mark C. Jansen, 1245 W. Dickens, Chicago, IL (US) 60614; Darcy L. Jansen, 1245 W. Dickens, Chicago, IL (US) 60614

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/090,131

(22) Filed: Jun. 3, 1998

(51) Int. Cl.[7] ..... A43B 1/10; A43C 15/02
(52) U.S. Cl. ..... 36/7.3; 36/127; 36/59 R
(58) Field of Search ..... 36/7.3, 7.6, 127, 36/59 R

(56) References Cited

U.S. PATENT DOCUMENTS

| | | | | |
|---|---|---|---|---|
| D10,774 | S | * | 8/1878 | Watkinson |
| 708,547 | A | * | 9/1902 | Hamilton et al. |
| 838,751 | A | * | 12/1906 | Roberts |
| 1,841,710 | A | | 1/1932 | Byrne et al. |
| 2,260,138 | A | | 10/1941 | Feinberg |
| 2,860,425 | A | * | 11/1958 | Jackson |
| 2,970,390 | A | | 2/1961 | Brough et al. |
| 3,026,635 | A | * | 3/1962 | Slade |
| 3,234,667 | A | * | 2/1966 | Bovay |
| 3,559,310 | A | | 2/1971 | Kiela |
| 3,616,552 | A | | 11/1971 | Kniffin et al. |
| 3,643,352 | A | | 2/1972 | Adair |
| 3,656,245 | A | * | 4/1972 | Wilson |
| 4,103,439 | A | * | 8/1978 | Abramson |
| 4,223,459 | A | * | 9/1980 | Riggs |
| 4,918,839 | A | * | 4/1990 | Brandon |
| 5,367,793 | A | * | 11/1994 | Deacon et al. |
| 5,600,901 | A | * | 2/1997 | Leonor |
| 5,623,774 | A | * | 4/1997 | Abbey |
| 5,782,017 | A | * | 7/1998 | Ortscheid |
| 5,848,482 | A | * | 12/1998 | Bathum |
| 5,860,228 | A | * | 1/1999 | Bathum |

FOREIGN PATENT DOCUMENTS

| | | | |
|---|---|---|---|
| GB | 2223394 | * | 4/1990 |
| GB | 2265299 | * | 9/1993 |

* cited by examiner

*Primary Examiner*—Ted Kavanaugh
(74) *Attorney, Agent, or Firm*—Bell, Boyd & Lloyd LLC

(57) ABSTRACT

The present invention provides new softspike overshoes for wearing over an existing shoe. The new softspike overshoes are suited for use in playing sports and are particularly suited for playing golf. The softspike overshoes are flexible yet sufficiently form retentive to securely hold their proper position on the shoe while playing golf. The softspike overshoe is a one-piece overshoe with soft spikes integrally molded into the bottom of the sole of the overshoe.

22 Claims, 2 Drawing Sheets

SOFTSPIKE OVERSHOES

FIELD OF THE INVENTION

The present invention generally relates to softspike overshoes and more specifically, the present invention relates to softspike overshoes having integrally molded softspikes particularly useful for playing sports.

BACKGROUND OF THE INVENTION

Sports are commonly played by a variety of participants, including amateurs and professional athletes. The appropriate equipment may be desired by a participant or even required to play a particular sport. Various types of sport shoes are commonly used during playing various sports, for example football shoes, baseball shoes, tennis shoes, bowling shoes and golf shoes. Some sport shoes have included spikes on the bottom of the shoes, for example golf shoes.

Golf shoes are worn over a golf player's foot and typically include shoelaces to tie and secure the golf shoe to the player. Existing golf shoes have included spikes on the bottom of the shoe, such as metal golf spikes and golf softspikes. Existing metal spikes and softspikes for golf shoes have been removably mounted to the bottom of the golf shoe by screw threads.

Golf shoes can be relatively bulky and heavy to transport to and from golf courses. Golf shoes can also be relatively expensive, particularly for the occasional golfer and beginning golfer who plays golf infrequently and may even be uncertain about continuing to play golf after initially trying the sport. Golfers have forgotten to bring their golf shoes to the golf course which means the golfer may either have to play without golf shoes or purchase another pair of new golf shoes at a pro shop. Younger golfers whose feet are still growing may have to purchase various pairs of golf shoes as their shoe sizes increase over the years.

Many golf courses are encouraging or even requiring the use of soft golf spikes on golf shoes. Softspikes on golf shoes tend to cause less damage to the golf courses, particularly the greens, as compared to the more traditional metal golf spikes.

Accordingly, it would be advantageous to have softspike overshoes which can be worn over a shoe for playing sports, particular for playing golf.

SUMMARY OF THE INVENTION

The present invention provides new softspike overshoes for wearing over an existing shoe. The new softspike overshoes are suited for use in playing sports and are particularly suited for playing golf. The softspike overshoes are flexible yet sufficiently form retentive to securely hold their proper position on the shoe while playing golf. The softspike overshoe is a one-piece overshoe with softspikes integrally molded into the bottom of the sole of the overshoe.

The softspike overshoe provides a convenient alternative to the traditional golf shoe. The new softspike overshoe can be easier to manufacture and relatively less costly than traditional golf shoes. A golf player may use a pair of softspike overshoes at least several times before the softspikes may be deteriorated or worn out. Accordingly, the softspike overshoes can be considered to be disposable because the relative cost can be quite low. Of course the softspike overshoes could be made from materials which last significantly longer such that the softspikes would not wear out quickly. The softspike overshoes can be made in various sizes, for example adult sizes for both men and women in small, medium, large and extra large and similar sizes for children.

One softspike overshoe according to the present invention includes a shoecover molded from a flexible material having a lower sole integrally molded with an upper portion to define a shoe receiving inside area. The softspike overshoe further has a plurality of ground engaging softspikes integrally molded from the same flexible material with the sole on an outside surface of the sole. The softspike overshoe may have a pair of lace holes on opposite sides of the overshoe which can be used to lace the overshoe directly and securely to the wearer's shoe. A pair of elastic stabilizing tabs having the lace holes may be connected to opposite sides of the overshoe across an opening for receiving the wearer's shoe. The softspike overshoe may have various areas which are re-enforced to provide greater rigidity and various other areas which may have a greater flexibility. The areas having relative flexibility and rigidity cooperate to ensure the softspike overshoe conforms to the wearer's shoe without excessively slipping relative to the wearer's shoe while being sufficiently flexible to permit the wearer to play a desire sport, such as golf.

One method of making a softspike overshoe according to the present invention includes molding a sole and molding a toe portion, an opposite heel portion and an arch portion between the toe and heel portions integrally in the sole. The arch portion of the sole is provided with greater flexibility than the toe and heel portions of the sole. A shoe-covering upper portion is integrally molded with the sole. The toe and heel portions of the sole may be provided with greater rigidity than the shoe-covering upper portion. A plurality of ground engaging softspikes are integrally molded with an outside surface of the sole. The shoe-covering upper portion may have a front stabilizing toe section and a rear stabilizing heel section which may be provided with greater rigidity the other portions of the shoe-covering upper portion.

The present invention provides new softspike overshoes and convenient, cost effective ways of making the overshoes. The softspike overshoes are a one-piece overshoe and include softspikes integrally molded into the outside of the sole. The softspike overshoes are particularly advantageous for use during playing golf.

An advantage of the present invention is to provide softspike overshoes which can be utilized to wear over existing shoes while playing sports, for example golf.

Another advantage of the present invention is to provide softspike overshoes which include integrally molded softspikes.

Another advantage of the present invention is to provide softspike overshoes which are disposable.

Another advantage of the present invention is to provide softspike overshoes which can be laced to the shoes over which they are worn.

Other objects and advantageous of the present invention will become apparent upon reading this disclosure including the appended claims with reference to the accompanying drawings.

DETAILED DESCRIPTION OF PRESENTLY PREFERRED EMBODIMENTS

Although the present invention can be made in many different forms, the presently preferred embodiments are described in this disclosure and shown in the attached drawings. This disclosure exemplifies the principles of the present invention and does not limit the broad aspects of the invention only to the illustrated embodiments.

Figures 1, 2:
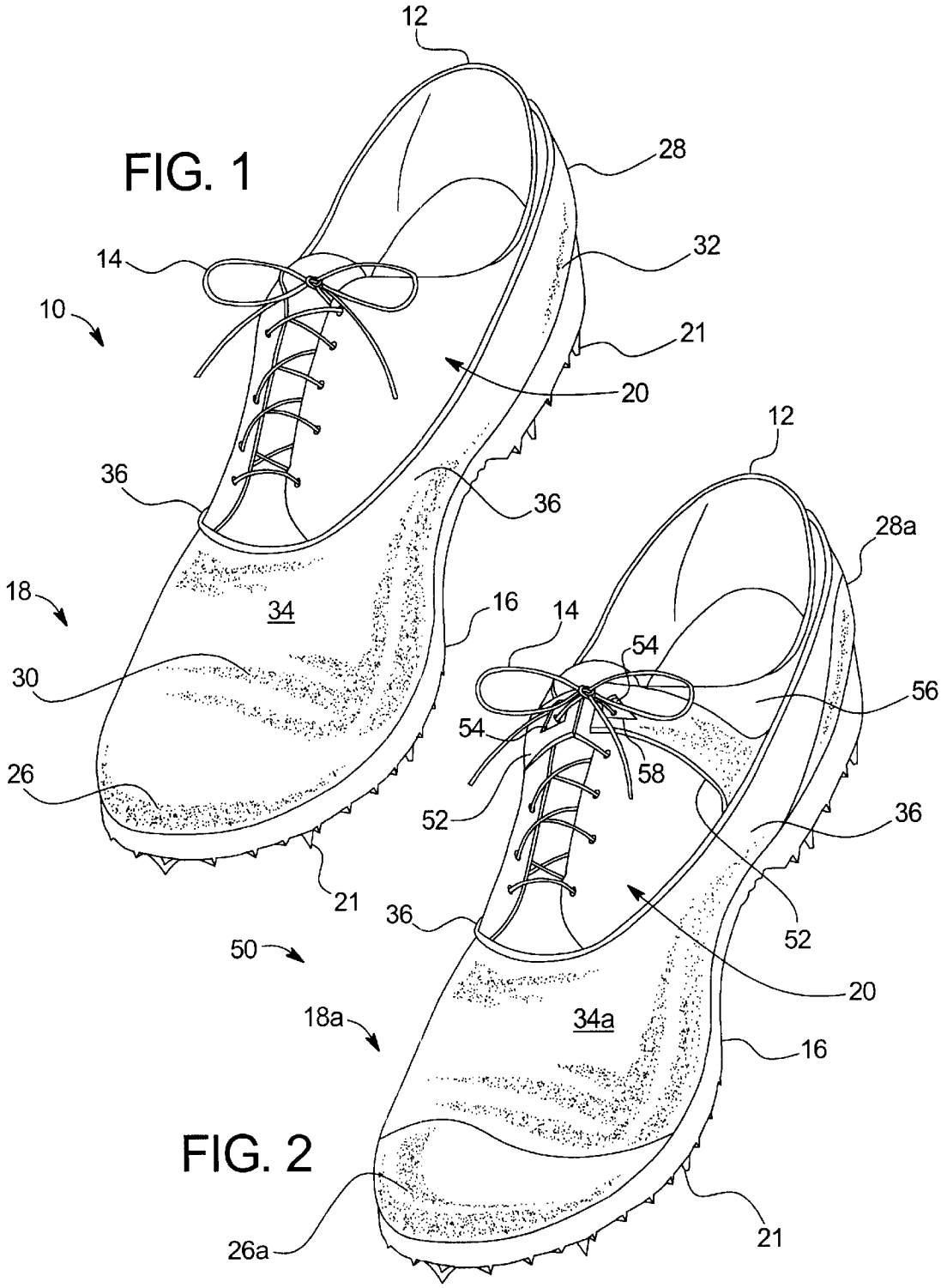
FIG. 1 is a perspective view of a softspike overshoe according to the principles of the present invention showing the softspike overshoe on a shoe.
FIG. 2 is a perspective view of another softspike overshoe according to the principles of the present invention showing the softspike overshoe on a shoe.

A new softspike overshoe 10 according to the principles of the present invention is shown by way of example in FIG. 1. The softspike overshoe 10 is shown in position over a lace-up shoe 12 having laces 14. In addition to lace-up shoes 12, the softspike overshoe 10 can be used with other types of shoes such as slip-on loafers, dress shoes, casual shoes, gym shoes and shoes having velcro type fasteners instead of laces, for example. The softspike overshoe 10 is a one uniform piece overshoe preferably made from rubber or plastic material. The material used to make the softspike overshoe should be strong and flexible to fit snugly around the entire shoe while permitting the wearer to participate in playing golf.

Figure 3:
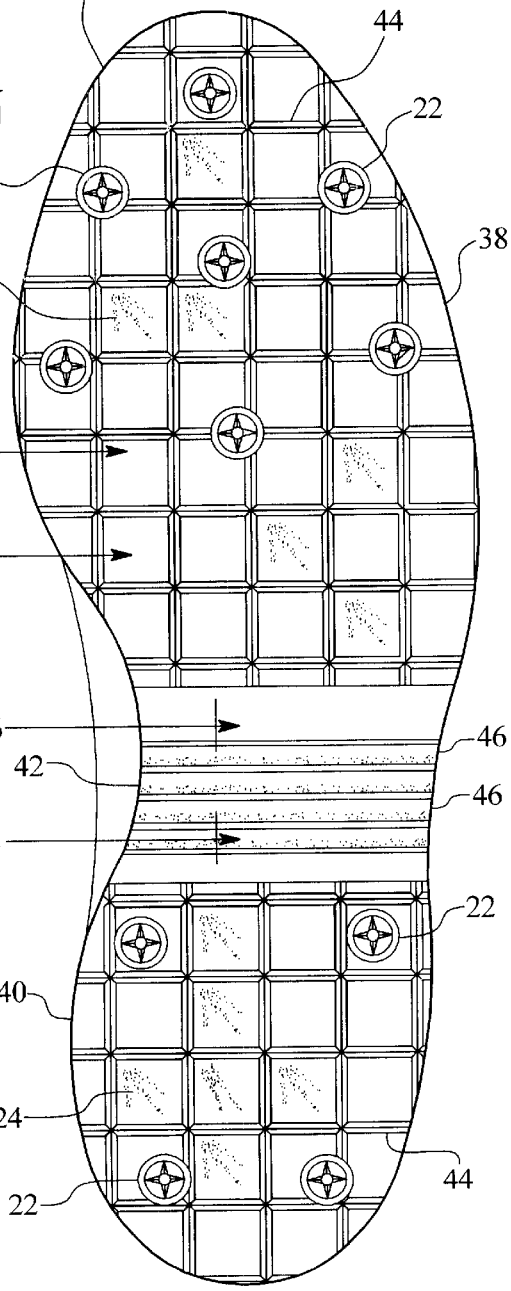
FIG. 3 is a bottom plan view of the softspike overshoe of FIG. 1.

The softspike overshoe 10 includes a lower sole, 16 integrally molded with an upper portion 18 to define a shoe receiving inside area 20. The lace-up shoe 12 is shown positioned in the inside area 20 of the softspike overshoe 10 in FIG. 1. The softspike overshoe 10 includes a plurality of ground engaging softspikes 21, integrally molded from the same material used to make the sole 16 and the, upper portion 18. Another softspike 22 usable with the softspike overshoe 10 is shown in FIG. 3. The softspikes 22 (FIG. 3) are shown as being integrally molded with the sole 16 on an outside surface 24 of the sole 16.

Referring to FIG. 1, the upper portion 18 of the softspike overshoe 10 has a front toe section 26 opposite a rear heel section 28 and an upper section 34 adjacent to and integral with the toe and heel sections 26, 28. The toe and heel sections 26, 28 and the upper section 34 of the upper portion 18 are sufficiently rigid and strong to stabilize the softspike overshoe 10 on the lace-up shoe 12, i.e. reduce or prevent the softspike overshoe 10 from slipping on the lace-up shoe 12 while playing golf. However, the toe and heel sections 26, 28 and the upper section 34 are sufficiently flexible to flex and move with the lace-up shoe 12 such as when the wearer is walking. The rigidity and flexibility of the toe and heel sections 26, 28 and the upper section 34 of the upper portion 18 can be adjusted as desired by providing those sections with various thicknesses or densities of the flexible material used to make the softspike overshoe 10, and varying the type of material used to make the softspike overshoe 10. Outer surfaces of the upper portion 18, for example an outer surface 30 of the toe section 26 and an outer surface 32 of the heel section 28, may be textured. The textured outer surfaces 30, 32 of the toe and heel sections 26, 28 provide increased durability and support throughout the use of the softspike overshoe 10.

Another softspike overshoe 50 according to the principles of the present invention is shown in FIG. 2. The upper portion 18*a* of the softspike overshoe 50 has a front toe section 26*a* opposite a rear heel section 28*a*. The toe and heel sections 26*a*, 28*a* of the upper portion 18*a* have a greater rigidity than the remaining sections of the upper portion 18*a*. The toe and heel sections 26*a*, 28*a* of the upper portion 18*a* further stabilize the softspike overshoe 50 on the lace-up shoe 12 by providing increased strength in those sections. The rigidity of the toe and heel sections 26*a*, 28*a* of the upper portion 18*a* can be increased by providing those sections with a greater thickness of the flexible material used to make the softspike overshoe 50. Also, the density of the material used, to make the softspike overshoe 50 can be increased in desired sections to increase the rigidity and provide for stabilizing the softspike overshoe 50 on the shoe 12. The upper portion 18*a* of the softspike overshoe 50 has a form fitting upper section 34*a* adjacent and integral with the toe and heel sections 26*a*, 28*a* of the upper portion 18*a*. The form fitting upper section 34*a* of the upper portion 18*a* may have greater flexibility than the toe and heel sections 26*a*, 28*a* while still fitting snugly around the shoe 12. The flexibility of the form fitting upper section 34*a* can be increased by reducing the material thickness, for example, of the flexible material used to make the softspike overshoe 50.

Referring back to FIG. 1, one softspike overshoe 10 according to the present invention has the toe section 26 of the upper portion 18 extending from the sole 16 up to approximately just below the laces 14 on the shoe 12. The heel section 28 of the upper portion 18 may extend from the sole 16 up to about ½ in. below the top of the back of the shoe 12, for example. The upper portion 18 may have sides 36 which extend up from the sole 16 a substantial distance to cover a majority of the sides of the shoe 12. Because the upper portion 18 substantially covers the entire shoe 12 any slipping between the softspike overshoe 10 and the shoe 12 during playing sports is reduced, i.e. stability of the softspike overshoe 10 on the shoe 12 is enhanced. The precise amount that the softspike overshoe 10 covers the shoe 12 may depend on various factors, for example the size and type of shoe, the size of the softspike overshoe 10 and the particular design of the softspike overshoe 10.

Figure 5:
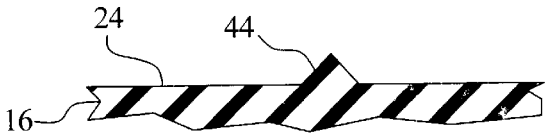
FIG. 5 is a cross-sectional view along the line 5—5 of FIG. 3.

A bottom view of the softspike overshoe 10 is shown in FIG. 3. The sole 16 of the softspike overshoe 10 has a toe portion 38 opposite a heel portion 40 and an arch portion 42 between the toe and heel portions 38, 40. The arch portion 42 has a greater flexibility than the toe and heel portions 38, 40 which may be provided by reducing the material thickness, for example, of the arch portion 42. The sole 16 is made from the same strong, flexible material as used in making the other portions of the softspike overshoe 10. The softspikes 22 are integrally molded into the sole 16 with the same material used to make the softspike overshoe 10, thus making the overshoe 10 one uniform piece. Also, the softspikes 22 are not removable because the softspikes 22 are integrally molded with the sole 16. The outside surfaces 24 of the toe portion 38 and heel portion 40 of the sole 16 may be textured. A raised grid 44 may also be provided on the toe and heel portions 38, 40 of the sole 16. The textured outside surfaces 24 and the raised grid 44 provide increased traction during playing golf. The raised grid 44 is shown in FIG. 3 as a square pattern; however, various types of patterns for the raised grid 44 can be used with the softspike overshoe 10. A cross sectional view of one raised grid 44 is shown in FIG. 5.

Figure 6:
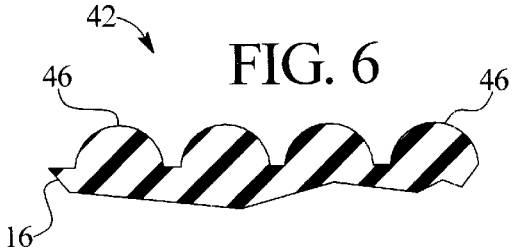
FIG. 6 is a cross-sectional view along the line 6—6 of FIG. 3.

As shown in FIGS. 3 and 6, the arch portion 42 of the sole 16 may have a plurality of raised ribs 46 extending widthwise across the arch portion 42. The arch portion 42 of the sole 16 has greater flexibility than the toe and heel portions 38, 40 of the sole 16. The increased flexibility of the arch portion 42 allows for the natural flex of the softspike overshoe 10 and the shoe 12 while the wearer is playing golf. The ribs 46 on the arch portion 42 reinforce the arch portion 42 to provide durability and strength. The flexibility of the arch portion 42 of the sole 16 may be increased by reducing the material thickness of the sole 16 in the arch portion 42. The sole 16, particularly the toe and heel portions 38, 40, may have a greater rigidity than the form fitting upper section 34 of the upper portion 18 shown in FIG. 1.

Figure 4:
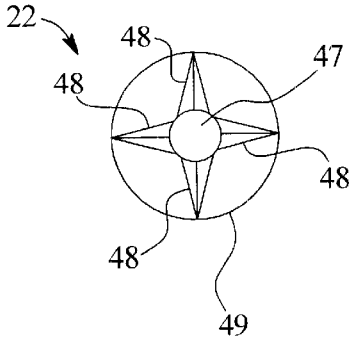
FIG. 4 is a plan view of a softspike usable with the softspike overshoe of FIG. 1.

The softspike 22 is one softspike usable with the softspike overshoe 10 of the present invention and is shown in FIG. 4. The softspike 22 has a center base 47 and one or more wing projections 48 extending outward away from the base 47. The wings 48 taper from a greater height at the base 47 downward toward the sole 16 to a lower height. The softspike 22 is made from the same material used to make the other portions of the softspike overshoe 10. The softspike 22, particularly the base 47 and the wings 48, are integrally molded with the sole 16 making the softspike overshoe 10 a one-piece structure. As can be seen in FIG. 4, the softspike 22 forms a star shape and one or more raised ridges 49 may partially or completely encircle the softspike 22. Various constructions of softspikes can be used with the softspike overshoe 10 of the present invention as long as the softspikes are integrally molded with the softspike overshoe 10. A greater or lesser number of softspikes 22 can be provided with the softspike overshoe 10 than shown in FIG. 3 as desired. The softspike 22 provides advantages when playing golf by reducing or eliminating damage caused to the golf course, particularly to the greens. The softspikes of the present invention reduce green damage because the spike protrusions on each softspike are more flexible and may have a lower height relative to traditional metal golf spikes, for example. The softspikes may have a greater number of spike protrusions which provide a greater surface area to engage the ground relative to traditional metal spikes. This provides for sufficient traction when playing golf.

The softspike overshoe 50 of FIG. 2 includes a pair of stabilizing tabs 52. Each one of the stabilizing tabs 52 is connected to one of the opposite sides 36 of the upper portion 18*a*. Lace holes 54 are provided in the upper portion 18*a*, particularly in the stabilizing tabs 52, for lacing the softspike overshoe 50 to the shoe 12. As shown in FIG. 2, the laces 14 of the shoe 12 extend through the lace holes 54 and are tied to resiliently stretch the stabilizing tabs 52 and secure the softspike overshoe 50 to the shoe 12. The stabilizing tabs 52 extend over an opening 56 to the shoe receiving inside area 20 of the softspike overshoe 50. A reinforced edge 58 may be provided around each lace hole 54 to increase the durability of the lace holes 54. The reinforced edge 58 of the lace holes 54 may be reinforced by providing the material used to make the softspike overshoe with a greater thickness around the lace holes 54, or a metal reinforcing ring may be provided around the lace holes 54, for example. The stabilizing tabs 52 and the lace holes 54 may provide the softspike overshoe 50 with a tighter fit on the shoe 12 which can reduce the possibility of slippage between the softspike overshoe 50 and the shoe 12.

The material used to make the softspike overshoe 10 (shown in FIG. 1) should be strong and have the capability of varying the flexibility and rigidity of the material. For example, material which may be suitable for use in making the softspike overshoe 10 may include rubber and plastic. The material used to make the softspike overshoe 10 may be transparent or opaque and may have a variety of colors.

One method of making the softspike overshoe 10 according to the principles of the present invention includes molding the sole 16 such that the sole 16 has the toe portion 38 opposite the heel portion 40 and the arch portion 42 positioned between the toe and heel portions 38, 40. The arch portion 42 of the sole 16 is provided with greater flexibility than the toe and heel portions 38, 40. The shoe covering upper portion 18 is integrally molded with the sole 16 and may include the upper portion 18*a* having the front stabilizing toe section 26*a* and the rear stabilizing heel section 28*a*. The toe and heel stabilizing sections 26*a*, 28*a* of the upper portion 18*a* may be provided with greater rigidity than the form fitting upper section 34*a* of the upper portion 18*a*. The toe and heel portions 38, 40 of the sole 16 are provided with greater rigidity than the upper portion 18. The ground engaging softspikes 22 are integrally molded with the outside surface 24 of the sole 16. Further steps in making the softspike overshoe 10 are apparent from reading the other portions of this disclosure including the claims and viewing the accompanying drawings.

While the presently preferred embodiments have been illustrated and described, numerous changes and modifications can be made without significantly departing from the spirit and scope of this invention. Therefore the inventors intend that such changes and modifications are covered by the appended claims.

The invention is claimed as:

1. A spiked overshoe comprising:

a shoecover molded from a flexible material and having a lower sole integrally molded with an upper portion to define a shoe receiving inside area; and a plurality of ground engaging spikes integrally molded from the flexible material with the sole on an outside surface of the sole and forming a continuous one-piece molding with the sole, each spike having a plurality of ground engaging protrusions extending in a direction away from the sole and being integrally molded with the sole as the continuous one-piece molding with the sole;

wherein the sole has greater rigidity than at least part of the upper portion of the shoecover;

wherein the upper portion of the shoecover has a stabilizing section adjacent and integral with the sole and a flexible, form fitting upper section adjacent and integral with the stabilizing section, the stabilizing section having greater rigidity than the flexible, form fitting upper section.

2. The spiked overshoe of claim 1 wherein the upper portion defines a pair of lace holes on opposite sides of the upper portion.

3. The spiked overshoe of claim 2 wherein the upper portion further comprises a pair of stabilizing tabs, each one of the stabilizing tabs connected to one of the opposite sides of the upper portion and extending over an opening to the shoe receiving inside area.

4. The spiked overshoe of claim 3 wherein the each one of the lace holes is located on one of the stabilizing tabs.

5. The spiked overshoe of claim 2 wherein each lace hole has a reinforced edge.

6. The spiked overshoe of claim 1 wherein the sole has a toe portion, an opposite heel portion and an arch portion between the toe and heel portions, the arch portion having greater flexibility than the toe and heel portions.

7. The spiked overshoe of claim 6 wherein the toe and heel portions have a textured outside surface.

8. The spiked overshoe of claim 1 wherein the sole comprises a central ribbed arch portion adjacent a front toe portion and a rear heel portion.

9. The spiked overshoe of claim 8 wherein the toe and heel portions have a textured outside surface.

10. The spiked overshoe of claim 1 wherein the sole has a raised grid on an outer surface.

11. The spiked overshoe of claim 1 wherein the flexible material is selected from the group consisting of plastic and rubber.

12. The spiked overshoe of claim 1 wherein the flexible material is substantially transparent.

13. The spiked overshoe of claim 1 wherein each spike comprises an integral projection extending away from the sole and a plurality of wings tapering from the projection toward the sole.

14. The spiked overshoe of claim 13 further comprising a raised ridge encircling the spike.

15. The spiked overshoe of claim 13 wherein the spike forms a star shaped pattern.

16. The spiked overshoe of claim 1 wherein the upper portion of the shoecover has a front toe section opposite a rear heel section, the toe and heel sections having greater rigidity than other sections of the upper portion of the shoecover, the toe and heel sections having textured outer surfaces.

17. The spiked overshoe of claim 1 wherein the spikes are flexible.

18. A spiked overshoe worn over a shoe while playing sports, the spiked overshoe comprising:

a sole formed from a flexible material and having a toe portion, an opposite heel portion and an arch portion between the toe and heel portions, the arch portion having greater flexibility than the toe and heel portions;

a shoe-covering upper portion formed from the flexible material and integral with the sole, the shoe-covering upper portion having a front stabilizing toe section and a rear stabilizing heel section, the toe and heel stabilizing sections having greater rigidity than an upper section of the shoe-covering upper portion, the toe and heel portions of the sole having greater rigidity than the upper section of the shoe-covering upper portion; and a plurality of ground engaging spikes formed from the flexible material and integral with an outside surface of the sole, each spike having a plurality of integral projections of the flexible material extending away from the sole and forming a continuous one-piece molding with the sole;

wherein the sole and upper portion substantially conform to the shoe when playing sports such that the spikes can engage a playing surface and provide traction.

19. The spiked overshoe of claim 18 wherein the shoe-covering upper portion defines lace holes on opposite sides of the shoe-covering upper portion.

20. The spiked overshoe of claim 19 wherein the shoe-covering upper portion further comprises a pair of stabilizing tabs, each one of the stabilizing tabs connected to one of the opposite sides of the shoe-covering upper portion.

21. The spiked overshoe of claim 18 wherein the toe and heel portions of the sole have a textured outside surface and a raised grid extending from the outside surface, the arch portion of the sole having raised ribs extending widthwise, and the toe and heel sections of the shoe-covering upper portion having a textured outer surface.

22. The spiked overshoe of claim 18 wherein the spikes are flexible.

* * * * *